US006755169B2

(12) United States Patent
Storz

(10) Patent No.: US 6,755,169 B2
(45) Date of Patent: Jun. 29, 2004

(54) INTAKE SYSTEM FOR AN INTERNAL-COMBUSTION ENGINE

(75) Inventor: Eberhard Storz, Kirchheim (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 49 days.

(21) Appl. No.: 10/214,179

(22) Filed: Aug. 8, 2002

(65) Prior Publication Data

US 2003/0029407 A1 Feb. 13, 2003

(30) Foreign Application Priority Data

Aug. 10, 2001 (DE) ..... 101 39 435

(51) Int. Cl.[7] ..... F02M 35/10
(52) U.S. Cl. ..... 123/184.21; 285/305
(58) Field of Search ..... 123/184.21; 285/305, 285/308, 367, 382, 382.1, 382.2; 29/505, 515

(56) References Cited

U.S. PATENT DOCUMENTS 3,141,686 A * 7/1964 Smith et al. ..... 285/383
3,149,362 A * 9/1964 Smithson ..... 285/305
4,182,121 A * 1/1980 Hall ..... 285/268
4,431,218 A * 2/1984 Paul et al. ..... 285/305
5,341,773 A * 8/1994 Schulte et al. ..... 285/305
5,595,151 A 1/1997 Powell et al.
5,868,438 A * 2/1999 Svetlik ..... 285/114

FOREIGN PATENT DOCUMENTS

GB 406 846 3/1934
GB 1 448 189 9/1976

* cited by examiner

*Primary Examiner*—Noah P. Kamen
(74) *Attorney, Agent, or Firm*—Crowell & Moring LLP

(57) ABSTRACT

The invention relates to an intake system for an internal-combustion engine having an air conduit, particularly an air pipe, whose end is captively and releasably fastened to an opening of a component of the internal-combustion engine. Receiving elements for fastening devices are provided at the opening of the component, which fastening devices reach through bearing sleeves fastened to the end of the air conduit.

8 Claims, 5 Drawing Sheets

INTAKE SYSTEM FOR AN INTERNAL-COMBUSTION ENGINE

BACKGROUND AND SUMMARY OF THE INVENTION

This application claims the priority of Application No. 101 39 435.7, filed Aug. 10, 2001 in Germany, the disclosure of which is expressly incorporated by reference herein.

The present invention relates to an intake system for an internal-combustion engine.

It is generally known from the prior art to captively fasten the air tubes or air hoses pertaining to the intake system of an internal-combustion engine to the corresponding components of the internal-combustion engine, such as the air filter housing, for example, by means of hose clamps or similar devices. As a result of the increasingly compact construction in the engine compartment, access for the mounting or demounting of such connections often becomes more difficult. Furthermore, it is endeavored to shorten the mounting times for the completion of the internal-combustion engine in the engine compartment of the motor vehicle.

It is therefore an object of the invention to provide a simple fastening, which can be released by a few manipulations, for the air conduits existing at the various engine components of the internal-combustion engine.

As a result of the receiving elements for the fastening devices and the bearing sleeves arranged on the air conduit, a fast and secure form-fitting connection of the two components is achieved in a simple manner.

According to the invention, additional advantageous further developments and improvements of the intake system can be implemented for an internal-combustion engine.

An effective and stable linking of the air conduit fastened to the component of the internal-combustion engine is obtained when the receiving elements for the fastening devices are molded to a collar surrounding the opening of the component, the end of the air conduit provided with a flange engaging in this collar.

The fastening devices constructed as locking pins have a detent at their end, which detent engages in the locked condition in a detent groove provided at the lower bearing eyes. As a result, the linking of the air conduit to the component is secured in a simple manner. High-expenditure thread-screw connections are therefore not necessary.

One elastomer ring respectively is provided between the head of the locking pins and the upper bearing eyes of the receiving elements. The locking pins can thereby be elastically pressed away in the axial direction, so that the detents provided at the end of the locking pins can be moved into the detent grooves provided at the lower bearing eyes and can be securely held in these detent grooves.

Other objects, advantages and novel features of the present invention will become apparent from the following detailed description of the invention when considered in conjunction with the accompanying drawings.

BRIEF DESCRIPTION OF THE DRAWINGS

An embodiment of the invention is illustrated in the drawings and will be described in detail in the following, in which.

DETAILED DESCRIPTION OF THE DRAWINGS

Figure 1:
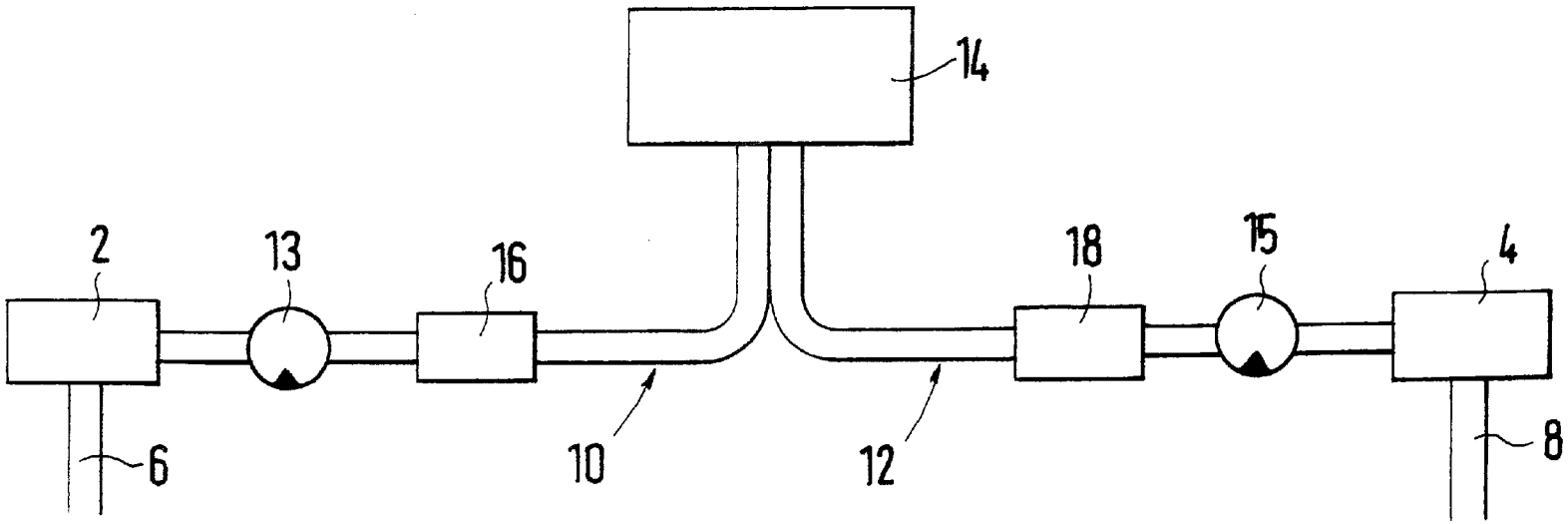
FIG. 1 is a schematic view of an intake system.
Figure 2:
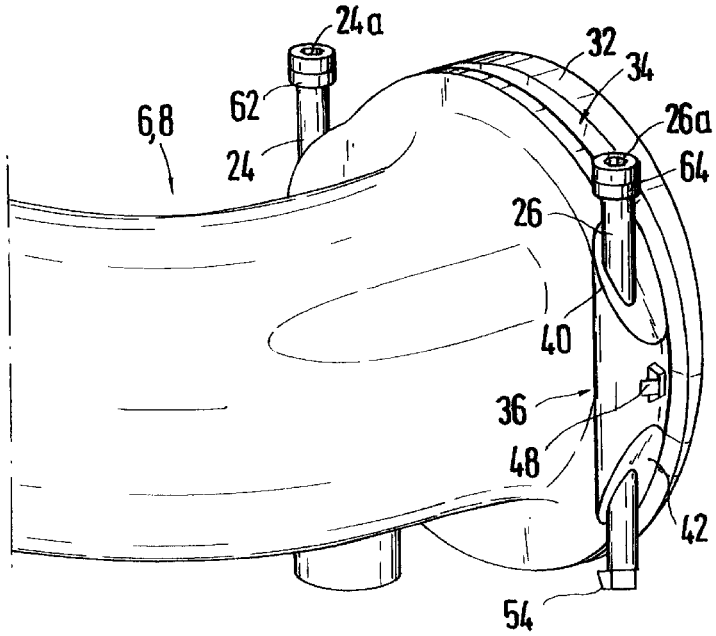
FIG. 2 is a view of an air elbow of the intake system.
Figure 3:
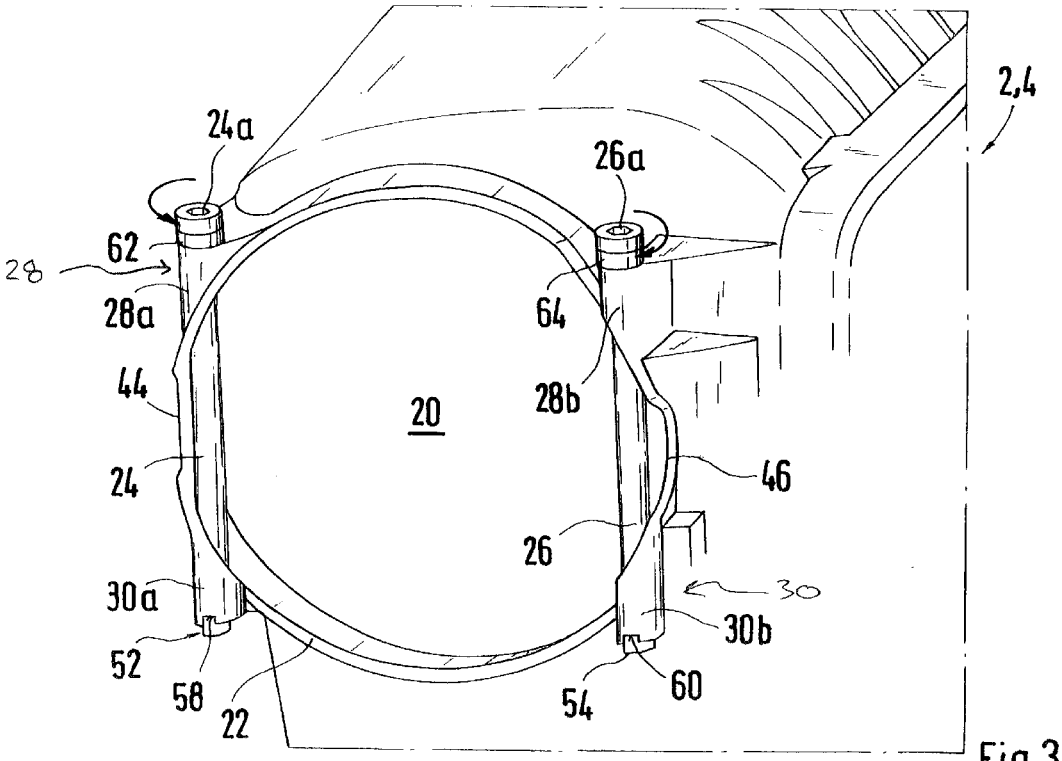
FIG. 3 is a partial view of an air filter housing pertaining to the intake system.
Figure 4:
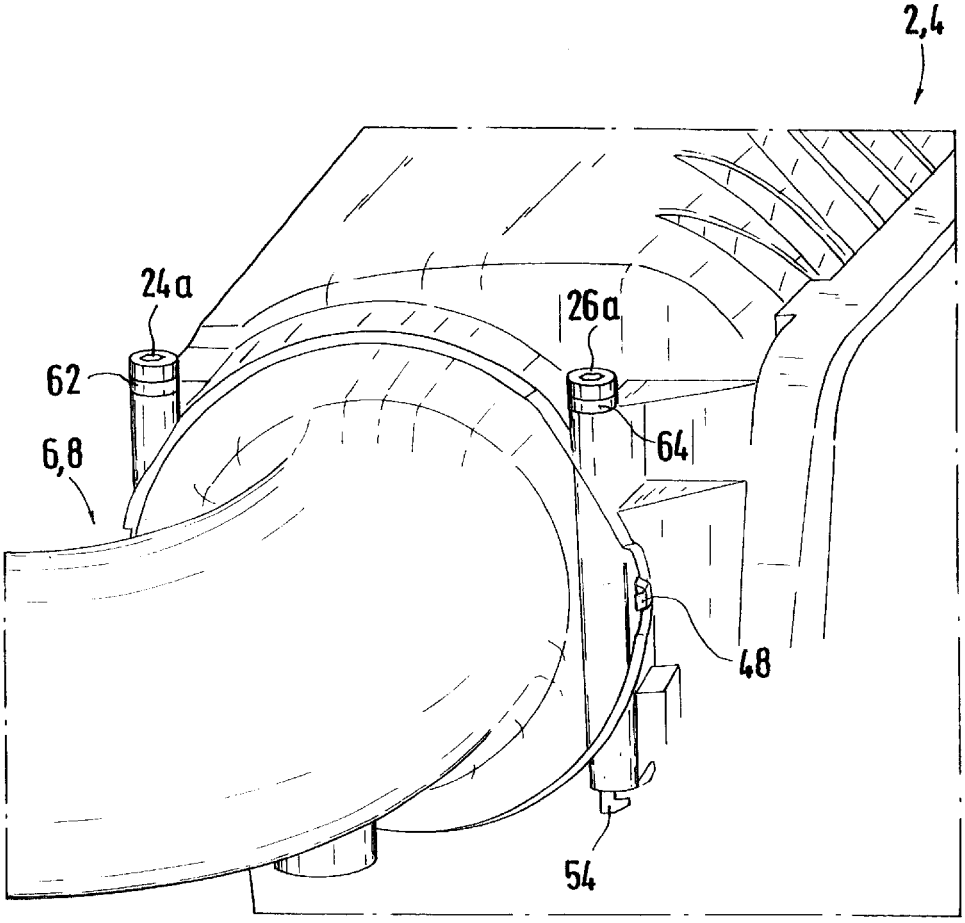
FIG. 4 is a view of the air conduit fastened to the air filter housing.
Figure 5:
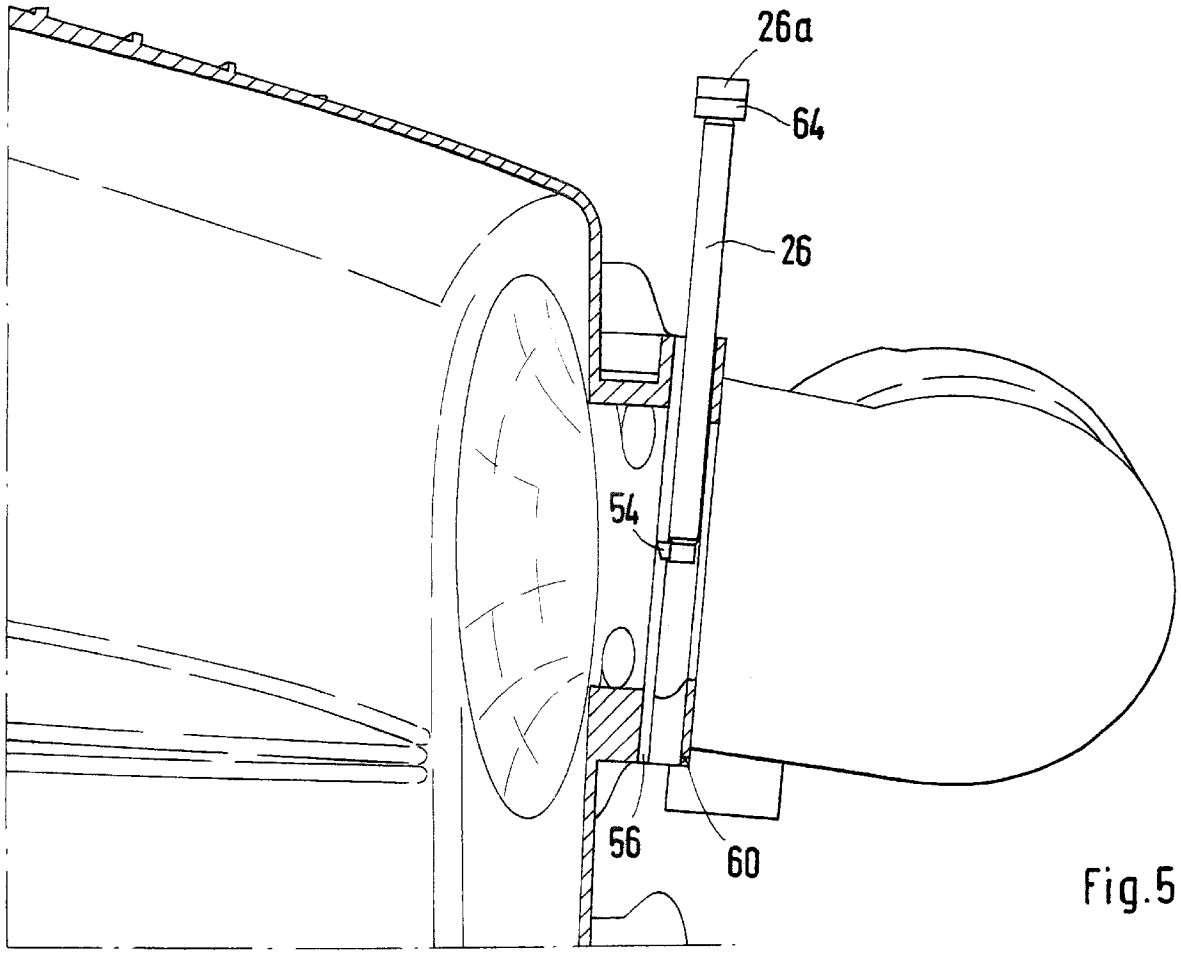
FIG. 5 is a sectional view of the fastening device.
Figure 6:
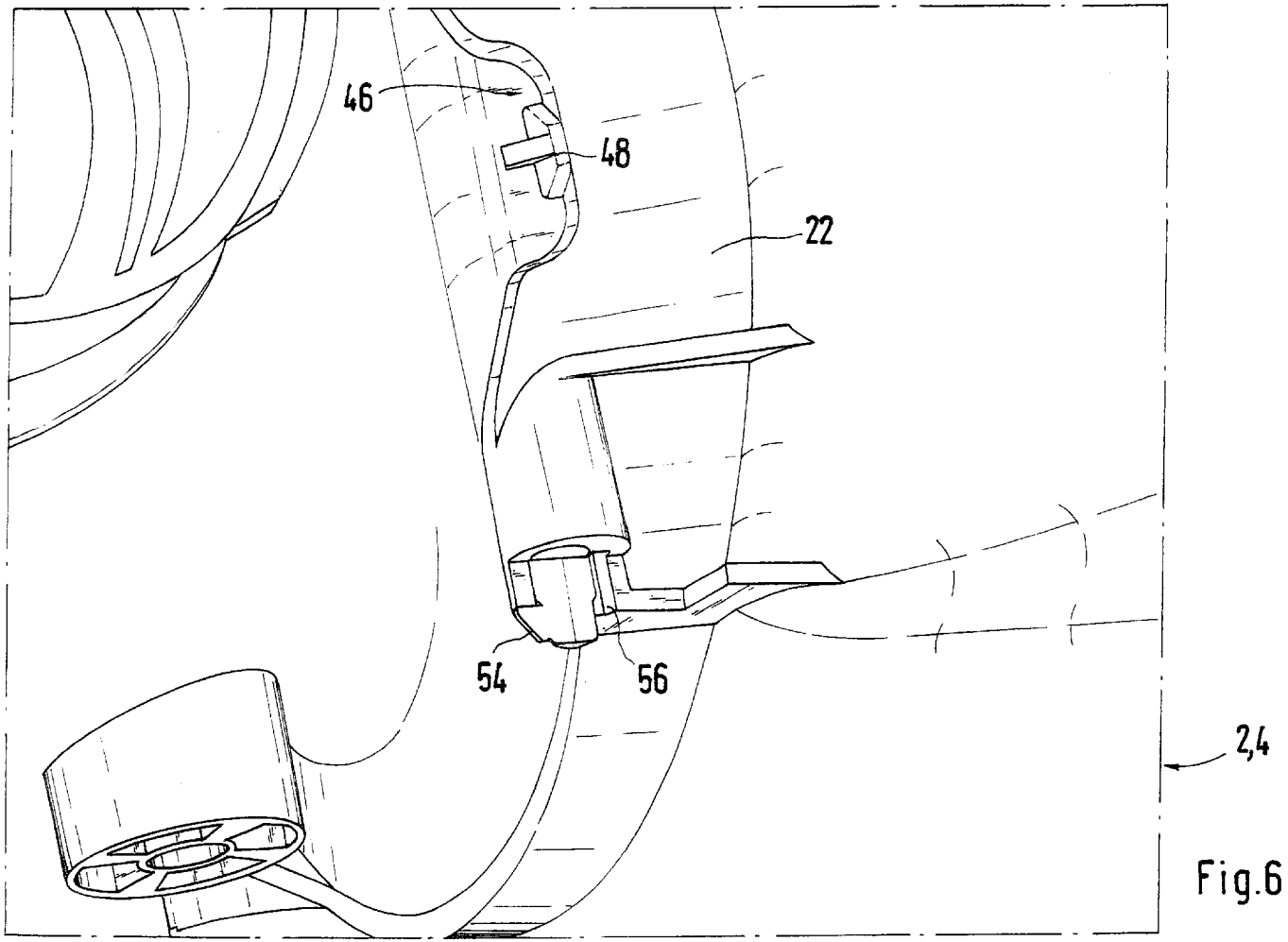
FIG. 6 is an enlarged cutout of air filter housing.

The intake system for a two-line internal-combustion engine with turbo-supercharging, for example, a V8 turbo-engine, schematically illustrated in FIG. 1, consists of one air conduit respectively which leads to an air filter housing 2 and 4 and which is constructed as an air elbow pipe 6 and 8. From the air filter housing 2 and 4, two pipe connections 10 and 12, respectively, lead to a throttle valve housing 14 fastened on the engine side to the suction system. Between the two air filters 2 and 4 and the throttle valve housing 14, two exhaust gas turbochargers 13 and 15 are arranged whose generated charge air is cooled by two air coolers 16 and 18 connected on the output side.

For fastening the air elbow pipe 6, 8 to the air filter housing 2, 4, an opening 20 is provided in the air filter housing 2, 4, which opening 20 is bounded by a ring collar 22. Two upper bearing eyes 28*a* and 28*b* as well as two lower bearing eyes 30*a* and 30*b* are provided on the ring collar 22 as receiving elements for two locking pins 24 and 26. The air elbow pipe 6, 8 has a flange section 32 which, in the mounted condition, engages in the ring collar 22 of the opening 20 of the air filter housing 2, 4. For sealing off the two components, the flange section 32 has a radially surrounding groove 34 into which an O-ring is placed which is not shown in detail. Adjoining the flange section 32, two laterally arranged bearing sleeves 36 are provided (only one being visible) which, in the mounted condition of both components, i.e., the air elbow pipe 6, 8 and the air filter housing 2, 4, are penetrated by the two locking pins 24, 26. The two bearing sleeves 36 each have two diagonally extending faces 40 and 42 which, in the mounted condition, come to rest on the interior wall of the ring collar 22. The ring collar 22 is provided with two recesses 44 and 46, respectively, which are used as a stop for two arresting pins 48 (only one being visible) protruding laterally beyond the flange section 32. As a result, the insertion depth of the air elbow pipe 6, 8 into the opening 20 of the air filter housing 2, 4 is limited such that the flange section 32 is completely received in the ring collar 22. The stop by way of the arresting pins 48 is coordinated such that the openings provided in the respective upper and lower bearing eyes 28*a* and 30*a*, 28*b* and 30*b*, respectively, correspond with the openings provided in the two bearing sleeves 36 or are aligned with respect to one another. As a result, the locking pins 24 and 26 used for fastening the air elbow pipes 6, 8 to the air filter housing 2, 4 can be fitted through the bearing eyes 28 and 30 and the bearing sleeves 36.

The locking pins 24 and 26 each have a detent 52 and 54 on their end, which detents 52 and 54, as described in detail in the following, are used for locking the fastening. So that the locking pins 24, 26 provided with the detent 52, 54 can be fitted through the openings provided in the upper and lower bearing eyes 28*a* and 30*a*, 28*b* and 30*b*, respectively, as well as in the bearing sleeves 36, the above-mentioned components each have an interior groove 56 by means of which the locking pins 24, 25 provided with the detent 52, 54 can be fitted through the openings. After the two locking pins 24, 26 have been fitted through the openings, the two locking pins 24, 26 will each be rotated by 180° respectively, whereby the detents 52, 54 are each engaged in a detent groove 58 and 60 provided at the lower bearing eyes 30*a*,

30*b*. So that the detents 52, 54 are securely held in the two detent grooves 58 and 60, one elastomer ring 62 and 64, respectively, is provided between the two heads 24*a* and 26*a* of the locking pins 24, 26 and the upper bearing eyes 28*a* and 28*b*. When the locking pins 24, 26 are moved into their locked position, the elastomer ring 62, 64 can be axially compressed. When the detents 52, 54 engage in the detent grooves 58, 60, the elastomer rings 62, 64 ensure the durable form-fitting locking of the component connection.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An intake system for an internal-combustion engine having an air conduit whose end is captively and releasably fastened at an opening of a component of the internal-combustion engine, wherein receiving elements for fastening devices are provided at the opening of the component, which fastening devices reach through bearing sleeves fastened to the end of the air conduit, wherein the receiving elements are two upper and two lower bearing eyes, and wherein the fastening devices are locking pins and further wherein each locking pin is guided through an upper and a lower bearing eye, and wherein the locking pins are provided at an end with a detent which, in a locked condition, engage in a detent groove provided in a respective lower bearing eye.

2. An intake system for an internal-combustion engine having an air conduit whose end is captively and releasably fastened at an opening of a component of the internal-combustion engine, wherein receiving elements for fastening devices are provided at the opening of the component, which fastening devices reach through bearing sleeves fastened to the end of the air conduit, wherein the receiving elements are two upper and two lower bearing eyes, and wherein the fastening devices are locking pins and further wherein each locking pin is guided through an upper and a lower bearing eye, and wherein an elastomer ring is provided between a head of a respective locking pin and an upper bearing eye.

3. Intake system for an internal-combustion engine, comprising:

an air conduit including a bearing sleeve;

an engine component defining an opening at an end of the component and including a receiving element at the opening; and a fastening device;

wherein an end of the air conduit is received within the opening of the component and wherein the fastening device is received within the bearing sleeve of the air conduit and the receiving element of the engine component, wherein the receiving element includes an upper bearing eye and a lower bearing eye and wherein the fastening device is a locking pin and further wherein the locking pin is received within the upper and lower bearing eyes, and wherein the locking pin includes a detent and wherein the lower bearing eye includes a detent groove and further wherein the detent is received within the detent groove.

4. Intake system for an internal-combustion engine, comprising:

an air conduit including a bearing sleeve;

an engine component defining an opening at an end of the component and including a receiving element at the opening; and a fastening device;

wherein an end of the air conduit is received within the opening of the component and wherein the fastening device is received within the bearing sleeve of the air conduit and the receiving element of the engine component, wherein the receiving element includes an upper bearing eye and a lower bearing eye and wherein the fastening device is a locking pin and further wherein the locking pin is received within the upper and lower bearing eyes, and wherein the ring is disposed between a head of the locking pin and the upper bearing eye.

5. A method for joining an air conduit having a bearing sleeve with an engine component having a receiving element at an opening of the engine component, comprising the steps of:

inserting an end of the air conduit into the opening of the engine component;

aligning the bearing sleeve with the receiving element;

inserting a fastening device within the aligned bearing sleeve and receiving element; and locking the fastening device by engaging a detent of the fastening device in a groove of the receiving element.

6. The method of claim 5 wherein the step of locking the fastening device includes the step of rotating the fastening device approximately 180°.

7. Method for joining an air conduit having a bearing sleeve with an engine component having a receiving element at an opening of the engine component, comprising the steps of:

inserting an end of the air conduit into the opening of the engine component;

aligning the bearing sleeve with the receiving element;

inserting a fastening device within the aligned bearing sleeve and receiving element; and limiting an insertion depth of the air conduit into the engine component by engaging a pin included on the bearing sleeve in a recess provided in the engine component.

8. A method for joining an air conduit having a bearing sleeve with an engine component having a receiving element at an opening of the engine component, comprising the steps of:

inserting an end of the air conduit into the opening of the engine component;

aligning the bearing sleeve with the receiving element;

inserting a fastening device within the aligned bearing sleeve and receiving element; and disposing a ring between a head of the fastening device and the receiving element.

* * * * *